US006601653B2

(12) United States Patent
Grabow et al.

(10) Patent No.: US 6,601,653 B2
(45) Date of Patent: Aug. 5, 2003

(54) METHOD AND SYSTEM FOR EXTINGUISHING FIRE IN AN ENCLOSED SPACE

(75) Inventors: Thomas Grabow, Emt i nghausen (DE); Konstantin Kallergis, Bremen (DE)

(73) Assignee: Airbus Deutschland GmbH, Hamburg (DE)

( * ) Notice: Subject to any disclaimer, the term of this patent is extended or adjusted under 35 U.S.C. 154(b) by 25 days.

(21) Appl. No.: 09/956,536

(22) Filed: Sep. 18, 2001

(65) Prior Publication Data

US 2002/0070035 A1 Jun. 13, 2002

(30) Foreign Application Priority Data

Oct. 18, 2000 (DE) ..... 100 51 662

(51) Int. Cl.[7] ..... A62C 35/00; A62C 2/00; A62C 3/00; A62C 37/10; B05B 15/06

(52) U.S. Cl. ..... 169/16; 169/11; 169/46; 169/60; 239/209

(58) Field of Search ..... 169/5, 9, 11, 16, 169/54, 56, 60, 61, 43, 46; 239/208, 209

(56) References Cited

U.S. PATENT DOCUMENTS

| | | | | |
|---|---|---|---|---|
| 3,893,514 A | * | 7/1975 | Carhart et al. | 169/46 |
| 4,566,542 A | | 1/1986 | Enk et al. | |
| 4,643,260 A | | 2/1987 | Miller | |
| 4,726,426 A | | 2/1988 | Miller | |
| 5,038,867 A | | 8/1991 | Hindrichs et al. | |
| 5,857,525 A | * | 1/1999 | Okamoto et al. | 169/11 |
| 5,957,210 A | | 9/1999 | Cohrt et al. | |
| 6,003,608 A | * | 12/1999 | Cunningham | 169/46 |
| 6,029,751 A | | 2/2000 | Ford et al. | |
| 6,082,464 A | * | 7/2000 | Mitchell et al. | 169/43 |
| 6,314,754 B1 | * | 11/2001 | Kotliar | 24/115 R |
| 6,418,752 B2 | | 7/2002 | Kotliar | |
| 2002/0040940 A1 | * | 4/2002 | Wagner et al. | 239/208 |

FOREIGN PATENT DOCUMENTS

| | | |
|---|---|---|
| DE | 3615415 | 11/1987 |
| DE | 3917205 | 8/1990 |
| DE | 4122446 | 1/1993 |
| DE | 19824300 | 10/1999 |
| EP | 0234056 | 9/1987 |

* cited by examiner

*Primary Examiner*—Michael Mar
*Assistant Examiner*—Darren Gorman
(74) *Attorney, Agent, or Firm*—W. F. Fasse; W. G. Fasse

(57) ABSTRACT

A system for suppressing fire in an enclosed space, e.g. an aircraft cabin or freight compartment, includes nitrogen tanks and/or generators to rapidly supply a limited quantity of nitrogen with-a high flow rate, and a membrane system to supply an essentially unlimited quantity of nitrogen at a lower supply rate for a long duration. The membrane system includes a selectively permeable membrane that separates nitrogen gas from ambient environmental air that is supplied into the membrane system. Once a fire is detected, nitrogen is supplied from the nitrogen gas tanks and/or generators at a high rate to rapidly increase the nitrogen concentration and establish a reduced oxygen concentration (e.g. 12 vol. %) in the enclosed space. Then, nitrogen is supplied from the membrane system at a reduced rate for a long duration to maintain the reduced oxygen concentration in the enclosed space until the fire is extinguished by oxygen starvation.

25 Claims, 1 Drawing Sheet

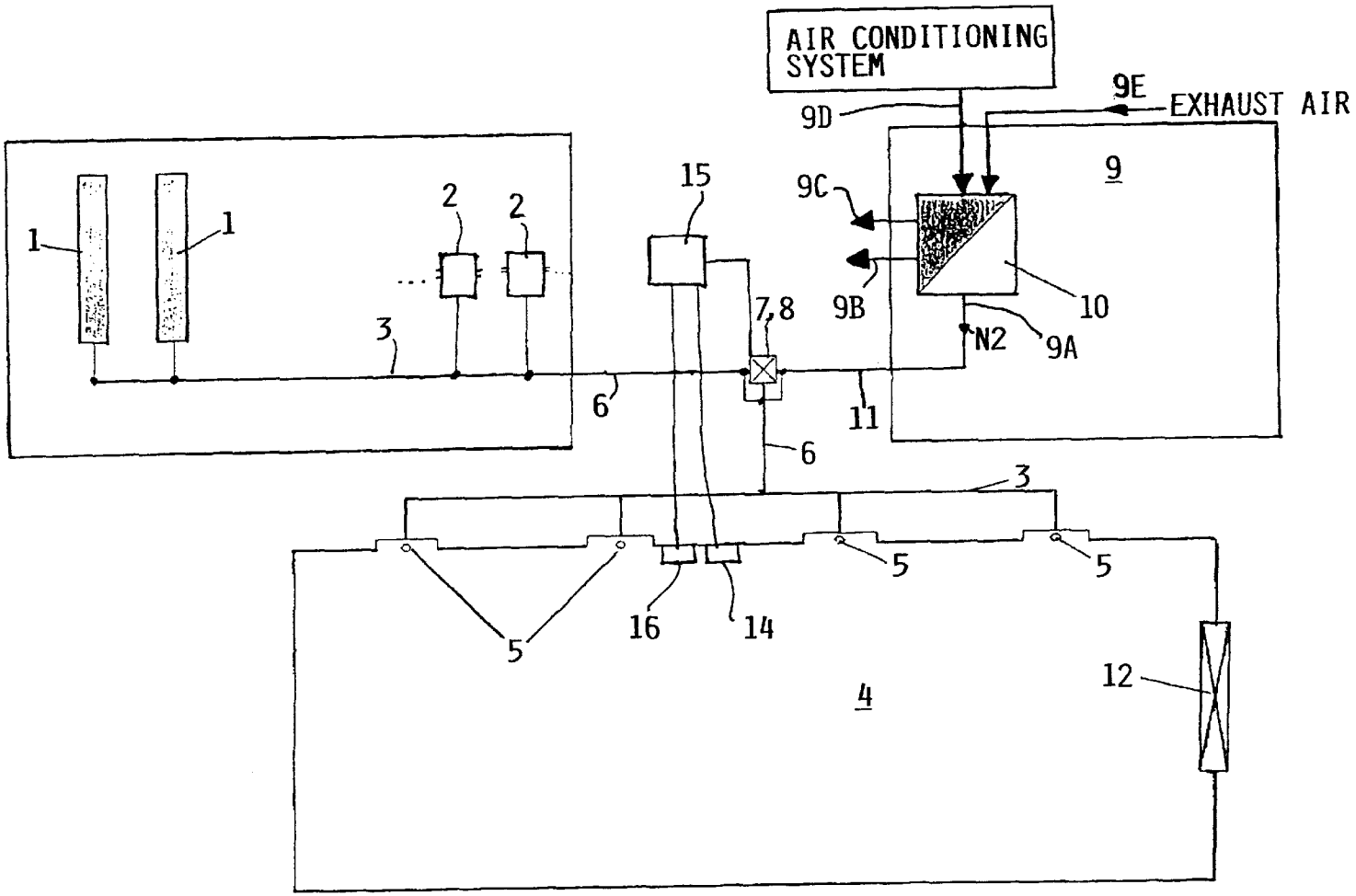
AIR CONDITIONING SYSTEM
9D
9E
EXHAUST AIR
9
10
9A
N2
9C
9B
11
7,8
6
15
14
16
12
5
3
4
2
1

METHOD AND SYSTEM FOR EXTINGUISHING FIRE IN AN ENCLOSED SPACE

PRIORITY CLAIM

This application is based on and claims the priority under 35 U.S.C. §119 of German Patent Application 100 51 662.9, filed on Oct. 18, 2000, the entire disclosure of which is incorporated herein by reference.

FIELD OF THE INVENTION

The invention relates to a method and a system for extinguishing a fire that has broken out in an enclosed space, for example in the cabin or a freight compartment of a passenger aircraft. Nitrogen is introduced into the enclosed space so as to displace the oxygen required for maintaining the fire, thereby extinguishing the fire.

BACKGROUND INFORMATION

A variety of different fire extinguishing methods and systems have become known for suppressing fires in public transportation vehicles. For example, German Patent Publication 36 15 415 C2 discloses a fire extinguishing arrangement including, two containers that respectively contain fire extinguishing agents in a liquid state under pressure, for generating first and second fire extinguishing charges for freight compartments of transportation vehicles, and especially aircraft. It is also known from the German Patent Publication 39 17 205 C1, to provide a firefighting arrangement for aircraft, that includes a fire extinguishing unit equipped with a drive arrangement and adapted to be movable along the longitudinal direction of the aircraft.

It is further known in the field of aircraft technology to provide a space or cabin flooding arrangement, for example in the manner of a freight compartment fire extinguishing system, which is supplied with halon 1301 gas to flood the associated enclosed space with the halon 1301. This also applies to firefighting flooding arrangements in fuel tanks or the like. On the other hand, in ships or other maritime applications, for example in cabins and machine rooms thereof, carbon dioxide and water sprinklers or water fogging arrangements are predominantly used for fire suppression. In the construction of buildings and the like, water sprinkler systems and carbon dioxide extinguisher arrangements are predominantly used for firefighting.

Such known arrangements have several disadvantages and are not suitable for use in enclosed spaces such as the cabin and freight compartment of an aircraft or the like. For example, some of the fire extinguishing agents used in such known systems are toxic, environmentally hazardous, and may cause damage to the aircraft or goods being transported therein. Moreover, the required supply of the fire extinguishing agent adds a substantial weight to the aircraft, and in any event only provides a limited supply of the extinguishing agent which will therefore be used up or exhausted after a limited time in a fire extinguishing application.

SUMMARY OF THE INVENTION

In view of the above, it is an object of the invention to provide a method and a system of the above described general type, which can achieve a fire suppression in an enclosed space during a nearly unlimited time frame, particularly by supplying a substantially continuous or unlimited quantity of a fire extinguishing agent. It is another object of the invention to utilize a fire extinguishing agent that is nontoxic to persons or animals in the effective utilized concentrations, not hazardous to the environment, and not contributing significantly to the overall weight of the aircraft or the like. The invention further aims to avoid or overcome the disadvantages of the prior art, and to achieve additional advantages, as apparent from the present specification.

The above objects have been achieved according to the invention in a fire extinguishing or suppression method which begins when a fire is detected in an enclosed space. Once a fire is detected, nitrogen is introduced into the enclosed space at a high rate so as to quickly increase the concentration of the inert gas nitrogen in the enclosed space in a sudden shock-like or step-like manner. Thereby, the initial rapid introduction of nitrogen into the enclosed space displaces oxygen (or generally the air) and thereby reduces the oxygen concentration in the enclosed space to a maximally effective fire extinguishing oxygen concentration. Then, in order to maintain this maximally effective fire extinguishing oxygen concentration in the enclosed space, nitrogen is further supplied at a prescribed rate or in a prescribed quantity into the enclosed space.

In other words, an initial rapid introduction of nitrogen drives the oxygen concentration down to the proper concentration for achieving a maximally effective fire suppression or extinguishing effect, and then the subsequent supply of nitrogen at a lower rate but in an essentially unlimited available supply quantity (e.g. in a continuous on-going manner for an essentially unlimited period of time) is effective to maintain the oxygen concentration at the appropriate level, preferably until the fire is extinguished. According to a particular embodiment of the invention, the maximally effective fire suppressing oxygen concentration within the enclosed space is reduced to and maintained in a range from 11 to 13 volume percent, or particularly approximately 12 volume percent, e.g. 11.5 to 12.5 volume percent.

The above objects have further been achieved according to the invention in an apparatus or system for carrying out the above described method. Such a system includes a compressed nitrogen gas bottle and/or a nitrogen gas generator connected by a pipe or conduit system to at least one extinguishing nozzle arranged within the associated enclosed space. A flow rate or quantity limiting device is arranged in the supply pipe line connecting the compressed nitrogen gas bottle and/or the nitrogen gas generator to the extinguishing nozzles. A nitrogen preparation unit is further connected to the flow rate limiting device for providing a further or continuous supply of nitrogen to maintain the maximally effective fire extinguishing oxygen concentration in the enclosed space.

According to a particular preferred embodiment of the invention, the nitrogen preparation unit comprises a membrane system, e.g. including at least one selectively permeable membrane, for selectively permeating nitrogen through this membrane and thereby separating nitrogen out of environmental air that is supplied to the nitrogen preparation unit. The nitrogen outlet of this membrane system is connected to the flow rate limiting device and/or to a pressure reservoir connected to the flow rate limiting device. The nitrogen preparation unit obtains its supply of input environmental air from the air conditioning system of a land vehicle, water vehicle or aircraft, or from an exhaust air flow that is supplied through a valve.

The invention provides and achieves at least the following advantages. The input air that is supplied to the membrane system for generating the nitrogen gas is available in essentially unlimited quantities outside of the enclosed space that is to be supplied with nitrogen, i.e. to have its oxygen concentration reduced to a maximally effective fire suppressing concentration. Since only nitrogen is used as the fire suppressing agent, the present method and system do not damage or deplete the stratospheric ozone, so that the present method and apparatus are environmentally friendly. Particularly, the present method and apparatus will not contribute to the so-called "greenhouse effect". Use of the present system and method will not cause any sort of damage to the goods being transported within the vehicle, or to the cabin interior equipment, fittings and furnishings. Moreover, the fire extinguishing agent, nitrogen, when provided in a concentration effective for fire suppression or extinguishing, is non-toxic to people and animals, so that it is not necessary to provide a prior warning interval before carrying out a fire extinguishing procedure, and it is possible to carry out fire extinguishing simultaneously while evacuating persons from the enclosed space. Since the nitrogen gas is rather stable and inert, no thermal decomposition products of the nitrogen will be formed below a temperature range of 1300 to 1500° C.

The invention can be advantageously utilized in various enclosed spaces including passenger cabins, crew cabins, and freight and cargo compartments or holds in various types of aircraft, ships, rail vehicles, public and private buildings, fuel tanks and the like, military vehicles and other military applications, industrial installations, such as in electronics compartments, freight compartments, equipment compartments, crew compartments, sleeping quarters, conference rooms, cabins, cockpits, machine control rooms, consoles and podiums, bridges, rail locomotives and self-powered cars, passenger and crew cars, freight wagons, experiment chambers and rooms of high schools, universities, and other organizations, museums, theaters, train stations, airports, hotels, military vehicles including personnel transport carriers, rocket launching bases, ammunition storage depots, machine and turbine rooms of power stations, and the like.

BRIEF DESCRIPTION OF THE DRAWINGS

In order that the invention may be clearly understood, it will now be described in connection with an example embodiment, with reference to the single accompanying drawing FIGURE, which is a schematic block diagram of a system for extinguishing a fire in an enclosed space according to the invention.

DETAILED DESCRIPTION OF PREFERRED EXAMPLE EMBODIMENTS AND OF THE BEST MODE OF THE INVENTION

The illustrated example of a fire extinguishing or suppression system according to the invention includes two compressed nitrogen gas bottles or tanks 1 and two nitrogen gas generators 2, which are all connected by a pipe or duct system 3 to plural extinguishing nozzles 5 arranged within the enclosed space 4 that is to be protected against fire. The nitrogen gas generators 2 may be any known nitrogen generator arrangements, e.g. carrying out a chemical reaction so as to release or generate nitrogen gas as a reaction product. Throughout this specification, the terms "fire extinguishing" and "fire suppression" both refer to the acts of reducing or entirely putting out a fire. In other words, the term "fire extinguishing" does not absolutely require entirely putting out the fire. Also throughout this specification, the term "pipe" and the like refers to any pipe, hose, conduit, duct, channel or the like that can be used to convey nitrogen into the enclosed space. The terms "gas bottle" and "gas tank" interchangeably refer to any container that is suitable for storing compressed nitrogen gas therein. The term "enclosed space" does not require absolute complete enclosure or hermetic sealing of the space, but rather refers to any space that is sufficiently enclosed to be able to establish and maintain a specified gas atmosphere therein.

A flow rate or quantity limiting device 7 is interposed n the supply line 6 of the pipe system 3 that connects the compressed nitrogen gas bottles 1 and the nitrogen gas generators 2 with the extinguishing nozzles 5. This flow rate limiting device 7 actively or passively controls the flow rate of nitrogen through the supply line to the extinguishing nozzles to appropriately carry out the inventive method. For example, the flow rate limiting device 7 supplies a high flow rate of nitrogen gas initially for a limited time after a fire is detected in the enclosed space 4. The fire is detected by a fire detector 14 such as a smoke detector or heat sensor, that provides corresponding signals to a controller 15, which accordingly controls the flow rate limiting device 7. The controller 15 may be implemented in an electronic circuit, in an integrated circuit on a chip, or in corresponding software being executed on a computer. Thereafter, once a maximally effective fire suppressing concentration of oxygen (or of nitrogen) has been achieved, e.g. as sensed by an oxygen sensor or nitrogen sensor 16 arranged in the enclosed space 4, then the flow limiting device 7 will supply a reduced flow quantity of nitrogen gas through the supply line 6 into the enclosed space 4. The detector 14 and sensor 16 may be connected for signal transmission to the controller 15 by any known signal transmission link, such an electrical conductor, an optical conductor, a radio transmission-link, an infrared transmission link, or the like.

A pressure reservoir 8 can be connected to, or especially connected in series circuit upstream from the flow rate limiting device 7, for temporarily taking up and storing any temporarily excessive quantity and/or pressure of the supplied nitrogen. Preferably, the compressed nitrogen gas bottles 1 and/or the nitrogen gas generators 2 are provided in a sufficient number or gas supply capacity, and are simultaneously triggerable dependent on the empty volume of the enclosed space 4, so as to quickly build up the desired starting concentration of the nitrogen inert gas in the enclosed space 4 by supplying a high flow rate of nitrogen once a fire is detected by the fire detector 14. Moreover, the enclosed space 4 is preferably equipped with a pressure compensation system 12, e.g. an excess pressure vent or the like, in order to prevent the enclosed space 4 from bursting as a result of the rapid influx of nitrogen gas, especially at the beginning of a fire suppression process.

A nitrogen preparation unit 9 is additionally connected as an input to the flow rate limiting device 7 and/or the pressure reservoir 8. This nitrogen preparation unit 9 serves to supply a substantially continuous (if required) flow of nitrogen gas for maintaining the maximally effective fire suppressing oxygen concentration within the enclosed space 4. Since the compressed nitrogen gas bottles 1 and/or the nitrogen gas generators 2 can rapidly supply a high flow rate of nitrogen, to quickly establish the required nitrogen and oxygen concentrations in the enclosed space 4 at the beginning of a fire suppression process, the nitrogen preparation unit 9 does not need to supply nitrogen at a very high flow rate. On the other hand, it is desired that the nitrogen preparation unit 9 can substantially continuously provide a low or moderate flow of nitrogen gas for an essentially unlimited duration to continuously maintain the appropriate nitrogen and oxygen concentrations in the enclosed space 4. The flow rate of nitrogen that can be supplied by the nitrogen bottles 1 and/or the nitrogen generators 2 is, for example, at least five times or even at least ten times the flow rate of nitrogen that can be supplied by the nitrogen preparation unit 9.

In this regard, preferably, the nitrogen preparation unit 9 comprises a membrane system 10 including one or more selectively permeable membranes for selectively separating nitrogen gas out of environmental air that is supplied into the membrane system 10. Any conventionally known membrane that is selectively permeable by nitrogen relative to oxygen (and preferably relative to other components of air) can be used in the membrane system 10. At an inlet 9D or 9E, the membrane system 10 receives ordinary ambient environmental air. The air being supplied to the membrane system 10 can be supplied from an air conditioning system through the inlet 9D, or from an exhaust air valve through an exhaust air inlet 9E. At a first outlet 9A, the membrane system 10 supplies nitrogen gas via a supply line 11 to the flow rate limiting device 7 or the pressure reservoir 8. The remaining components of the air (with a reduced or eliminated nitrogen content) are either dumped overboard from the aircraft through a vent outlet 9B, or returned to an air conditioning system through an outlet 9C. Since the supply of environmental ambient air is essentially unlimited, the membrane system 10 can continuously supply the separated nitrogen component to the fire suppression system, as long as air can continue to be supplied to the membrane system 10.

Although the invention has been described with reference to specific example embodiments, it will be appreciated that it is intended to cover all modifications and equivalents within the scope of the appended claims. It should also be understood that the present disclosure includes all possible combinations of any individual features recited in any of the appended claims.

What is claimed is:

1. A system for suppressing a fire in an enclosed space, comprising:

at least one nitrogen supply device selected from the group consisting of compressed nitrogen gas storage tanks and nitrogen gas generators, adapted to supply a first flow of nitrogen gas;

a nitrogen preparation unit adapted to supply a second flow of nitrogen gas, at a lower maximum flow rate and for a longer maximum duration than said first flow of nitrogen gas supplied by said at least one nitrogen supply device;

at least one nozzle that is arranged in the enclosed space and that is adapted to emit nitrogen gas from said nozzle into the enclosed space;

a pipe arrangement connecting said at least one nitrogen supply device and said nitrogen preparation unit to said at least one nozzle;

a flow rate limiting device interposed in said pipe arrangement with said at least one nozzle located on an outlet side of said flow rate limiting device and with said at least one nitrogen supply device and said nitrogen preparation unit located on an inlet side of said flow rate limiting device; and a pressure reservoir interposed in said pipe arrangement and connected to said flow rate limiting device upstream on said inlet side thereof.

2. The system according to claim 1, further comprising a controller connected for control signal transmission to said flow rate limiting device, a fire detector arranged in the enclosed space and connected by a detector signal transmission link to said controller, and a gas sensor arranged in the enclosed space and connected by a sensor signal transmission link to said controller.

3. The system according to claim 2, wherein said gas sensor comprises an oxygen gas concentration sensor.

4. The system according to claim 2, wherein said gas sensor comprises a nitrogen gas concentration sensor.

5. The system according to claim 1, wherein said at least one nitrogen supply device is adapted to supply said first flow of nitrogen gas through said pipe arrangement and said at least one nozzle into the enclosed space so as to reduce an ambient oxygen concentration to establish a reduced oxygen concentration in the enclosed space, and said nitrogen preparation unit is adapted to supply said second flow of nitrogen gas through said pipe arrangement and said at least one nozzle into the enclosed space so as to maintain said reduced oxygen concentration in the enclosed space.

6. The system according to claim 5, wherein said reduced oxygen concentration is a maximally effective fire suppressing concentration of oxygen.

7. The system according to claim 1, comprising a plurality of said nitrogen supply devices that can all be activated simultaneously to cumulatively together supply said first flow of nitrogen gas to initially build up an initial concentration of nitrogen gas in the enclosed space.

8. The system according to claim 1, excluding halon, carbon dioxide, and water as fire suppressing agents.

9. The system according to claim 1, including and using only nitrogen gas as a fire suppressing agent.

10. The system according to claim 1, wherein said nitrogen preparation unit comprises a membrane system that selectively separates nitrogen gas from air, and wherein said membrane system has an air inlet and has a nitrogen outlet connected to said pipe arrangement.

11. The system according to claim 1, further comprising a pressure compensating device connected to the enclosed space.

12. A system for suppressing a fire in an enclosed space, comprising:

at least one nitrogen supply device selected from the group consisting of compressed nitrogen gas storage tanks and nitrogen gas generators, adapted to supply a first flow of nitrogen gas;

a nitrogen preparation unit adapted to supply a second flow of nitrogen gas, at a lower maximum flow rate and for a longer maximum duration than said first flow of nitrogen gas supplied by said at least one nitrogen supply device, wherein said nitrogen preparation unit comprises a membrane system that selectively separates nitrogen gas from air, and wherein said membrane system has an air inlet and has a nitrogen outlet;

at least one nozzle that is arranged in the enclosed space and that is adapted to emit nitrogen gas from said nozzle into the enclosed space;

a pipe arrangement connecting said at least one nitrogen supply device and said nitrogen outlet of said nitrogen preparation unit to said at least one nozzle; and an exhaust air outlet channel and a valve interconnected between said exhaust air outlet channel and said air inlet of said membrane system to provide air to said air inlet.

13. The system according to claim 12, further in combination with a vehicle equipped with an air conditioning system, wherein said exhaust air outlet channel is connected to said air conditioning system to receive the air therefrom and to provide the air to said air inlet of said membrane system.

14. The system according to claim 12, wherein said membrane system includes at least one selectively permeable membrane that is selectively permeable by nitrogen, so as to allow nitrogen to pass through said membrane from a side thereof facing said air inlet to a side thereof facing said nitrogen outlet.

15. A method of suppressing a fire in an enclosed space, comprising the steps:

a) detecting a fire in an enclosed space;

b) after said step a) and in response thereto, supplying a first flow of nitrogen gas at a first flow rate from at least one nitrogen supply device selected from the group consisting of a nitrogen gas storage tank and a nitrogen gas generator, into said enclosed space so as to reduce a prior oxygen concentration to a reduced oxygen concentration in said enclosed space;

c) after said step b), supplying a second flow of nitrogen gas at a second flow rate from a nitrogen preparation unit including a membrane that is selectively permeable with respect to nitrogen, into said enclosed space so as to maintain said reduced oxygen concentration in said enclosed space, wherein said first flow rate is greater than said second flow rate; and d) extinguishing said fire because said reduced oxygen concentration is insufficient to sustain said fire.

16. The method according to claim 15, wherein said first flow rate is at least five times said second flow rate.

17. The method according to claim 15, wherein said first flow rate is at least ten times said second flow rate.

18. The method according to claim 15, wherein said first flow rate is a maximum possible flow rate that can be achieved by said at least one nitrogen supply device that is supplying said nitrogen gas.

19. The method according to claim 15, wherein said supplying of said second flow of nitrogen gas is carried out for a longer duration than said supplying of said first flow of nitrogen gas.

20. The method according to claim 15, wherein said supplying of said first flow of nitrogen gas is continued only until said reduced oxygen concentration is achieved in said enclosed space and is then discontinued, and said supplying of said second flow of nitrogen gas is continued until said fire has been completely extinguished and is then discontinued.

21. The method according to claim 15, wherein said reduced oxygen concentration is a maximally effective fire extinguishing concentration of oxygen.

22. The method according to claim 15, wherein said reduced oxygen concentration is in a range from 11 to 13 volume percent.

23. The method according to claim 15, wherein said reduced oxygen concentration is about 12 volume percent.

24. The method according to claim 15, excluding the use of halon, carbon dioxide, and water for extinguishing said fire.

25. The method according to claim 15, using only said nitrogen gas for extinguishing said fire.

* * * * *